US005590890A

United States Patent [19]

Rosso et al.

[11] Patent Number: 5,590,890

[45] Date of Patent: Jan. 7, 1997

[54] ROLLER SKATE

[75] Inventors: Francesco Rosso; Giuseppe A. Rosso; Ettore Carenini, all of Turin, Italy

[73] Assignee: Jack L. Forcelledo, Los Angeles, Calif.

[21] Appl. No.: 61,583

[22] Filed: May 12, 1993

Related U.S. Application Data

[63] Continuation-in-part of Ser. No. 831,392, Feb. 7, 1992, Pat. No. Des. 337,805.

[51] Int. Cl.[6] ..... A63C 17/04

[52] U.S. Cl. ..... 280/11.22; 280/11.27; 301/5.3

[58] Field of Search ..... 280/11.19, 11.22, 280/11.23, 11.27, 11.28, 87.042; 301/5.3

[56] References Cited

U.S. PATENT DOCUMENTS

| | | |
|---|---|---|
| D. 236,741 | 9/1975 | Smith . |
| D. 238,386 | 1/1976 | Smith . |
| D. 241,868 | 10/1976 | Smith . |
| D. 262,130 | 12/1981 | Yoshimoto . |
| D. 264,612 | 5/1982 | Szegi . |
| D. 265,115 | 6/1982 | Dornseif . |
| 971,164 | 9/1910 | Yoxall et al. . |
| 1,186,074 | 6/1916 | Brown . |
| 2,073,708 | 3/1937 | Parrish . |
| 3,693,988 | 9/1972 | Steinhser . |
| 3,936,061 | 2/1976 | Wada . |
| 4,034,995 | 7/1977 | Forward et al. . |
| 4,090,283 | 5/1978 | Woolley . |
| 4,135,763 | 1/1979 | Kosono et al. . |
| 4,138,127 | 2/1979 | Kimmell et al. . |
| 4,373,736 | 2/1983 | Stumbaugh . |
| 4,392,659 | 7/1983 | Yoshimoto . |
| 4,418,929 | 12/1983 | Gray . |
| 4,844,492 | 7/1989 | Ludwig . |
| 5,028,058 | 7/1991 | Olson . |

FOREIGN PATENT DOCUMENTS

| | | |
|---|---|---|
| 994825 | 8/1976 | Canada . |
| 0349943 | 1/1990 | European Pat. Off. . |
| 0469639 | 2/1992 | European Pat. Off. . |
| 959408 | 3/1950 | France . |
| 2312174 | 5/1976 | France . |
| 2603883 | 8/1977 | Germany . |

*Primary Examiner*—Richard M. Camby
*Attorney, Agent, or Firm*—Jeffer, Mangels, Butler & Marmarlo LLP

[57] ABSTRACT

An improved roller skate includes a shoe portion, front and rear wheels, and a bracket coupling the wheels to the shoe portion. The have a "generally" spherical shape which allows the skater to maintain a rolling surface of each wheel on the floor or ground, while leaning the skate by a relatively large degree with respect to a line extending perpendicular to the floor or ground. Each wheel has a rigid inner core and a softer outer cover. The inner core includes an axle housing connected to a hollow, "generally" spherical, rigid shell by a plurality of radially extending spokes. The bracket coupling the wheels to the shoe portion includes arms coupled to the wheel axles. The shape of the bracket and bracket arms are designed for strength as well as to allow for a high degree of skate inclination (lean or angle) with respect to the ground or floor without contacting and scraping the ground or floor.

12 Claims, 5 Drawing Sheets

ROLLER SKATE

RELATED APPLICATIONS

The present application is a continuation-in-part of application no. 07/831,392 filed Feb. 7, 1992 now U.S. Pat. No. Des. 337,805.

BACKGROUND OF THE INVENTION

1. Field of the Invention

The present invention relates to improved roller skates and methods for making the same and, in particular embodiments, to a high-performance roller skates having a light-weight wheel bracket and light-weight wheels defining generally spherical shaped roller surfaces which allow a skater to lean or incline the skate to a relatively large degree.

2. Description of Related Art

Early roller skate designs employed generally disk-shaped wheels having relatively narrow outer peripheral surfaces defining the rolling surfaces. The rolling surfaces are the surfaces of the wheels which contact the floor or ground during a controlled roll on the floor or ground. The rolling surface of a typical conventional wheel design abruptly ends at each side wall of the wheel. Thus, if a skater leaned too far to one side while skating, the rolling surfaces of the skate wheels would lose contact with the floor or ground, causing the skater to lose control and/or fall to that side.

Various prior roller skate designs employed four of such disk-shaped wheels supported on a pair of axles. Two wheels were supported on one axle mounted toward the front of the skate and two wheels were supported on the other axle mounted toward the back of the skate. Early roller skate wheels were made of generally hard materials, such as steel or ceramic materials. More modern roller skate wheels have been made of a softer rubber or plastic material.

Recently, "in-line" skates have become popular. These "in-line" skates have, for example, four generally disk-shaped wheels, each supported on its own axis, arranged in a line along the length of the skate. In various "in-line" skate designs, the mounting brackets for coupling the wheels and axles to the shoe part extend adjacent the side walls of the wheels. The location of these mounting brackets tends to allow portions of the bracket to scrape the ground or floor, if the skater where to lean the skate too far to either side. Thus, the degree to which the skater can lean, for example, during high speed turns or trick maneuvers, is severely limited by the wheel mounting bracket, as well as by the generally disk-like shape of the wheels.

"In-line" skates can, to some extent, give the skater a riding sensation which is closer (relative to the two-wheels -per-axle roller skates) to that of riding on ice skates. Typical ice skates are provided with a thin blade for contacting the ice. Generally, the bottom edge of the thin blade can remain in contact with the ice, even when the skater leans the skate to one side, e.g., during a high-speed turn. However, as discussed above, typical "in-line" roller skates cannot be leaned to a significant degree to one side without scraping the wheel bracket against the ground and/or without the user's ankles collapsing inward and the rolling surface of the wheels losing contact with the ground, as discussed above. Thus, typical "in-line" skates still do not provide performance characteristics equal to or near those provided by ice skates.

SUMMARY OF THE DISCLOSURE

An object of an embodiment of the invention is to provide an improved high-performance roller skate. A further object of an embodiment of the invention is to provide an improved roller skate which gives the user a sensation similar to that of riding ice skates. A further object of an embodiment of the invention is to provide an improved roller skate having a light-weight design and which allows the user to maintain a rolling surface of each wheel on the floor or ground, while leaning the skate by a relatively large degree with respect to a line extending perpendicular to the floor or ground. A further object of an embodiment of the invention is to provide a method of making a roller skate as discussed above.

An improved roller skate, according to an embodiment of the present invention, includes a shoe portion, front and rear wheels, and a bracket coupling the wheels to the shoe portion. The wheels have a "generally" spherical shape which allows the skater to maintain a rolling surface of each wheel on the floor or ground, while leaning the skate by a relatively large degree with respect to a line extending perpendicular to the floor or ground.

Each wheel has a rigid inner core and a softer outer cover. The inner core includes an axle housing connected to a hollow, "generally" spherical, rigid shell by a plurality of radially extending spokes. The spoked structure provides a light-weight inner core and sufficient strength for enduring the rigorous strains experienced by a roller skate wheel. For ease of manufacturing, the inner core is made of a two piece structure, mechanically coupled to form a "generally" spherical core. The outer cover is injection molded about the mechanically coupled core.

The bracket coupling the wheels to the shoe portion includes arms coupled to the wheel axles. The shape of the bracket and bracket arms are designed for strength as well as to allow for a high degree of skate inclination (lean or angle) with respect to the ground or floor without contacting and scraping the ground or floor.

BRIEF DESCRIPTION OF THE DRAWINGS

The detailed description will be made with reference to the accompanying drawings, wherein like numerals designate corresponding parts in the several figures.

DETAILED DESCRIPTION OF THE PREFERRED EMBODIMENTS

The following detailed description is of the best presently contemplated mode of carrying out the invention. This description is not to be taken in a limiting sense, but is made merely for the purpose of illustrating the general principles of embodiments of the invention. The scope of the invention is best defined by the appended claims.

Figure 1:
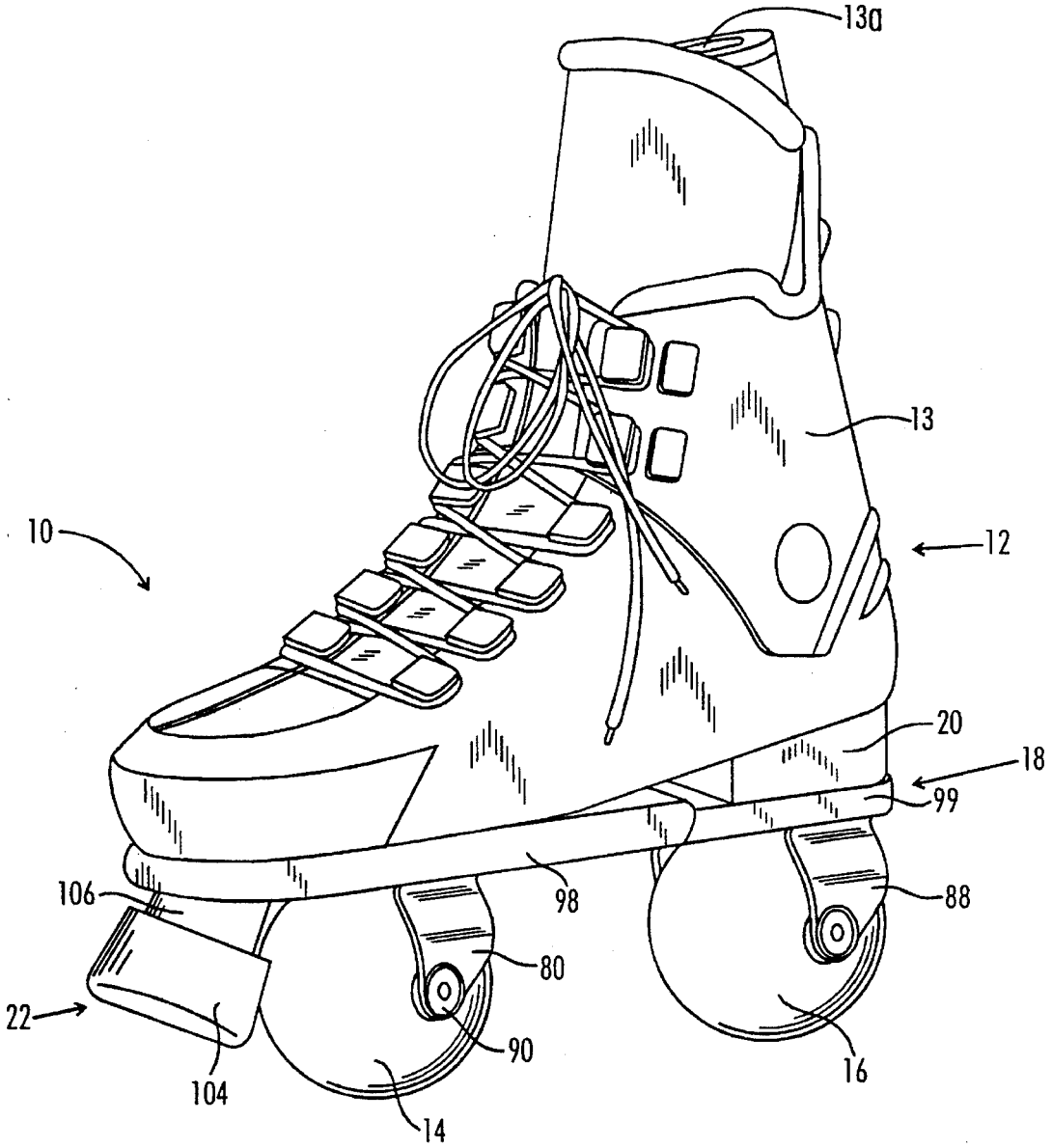
Figure 1 is a perspective view of an improved roller skate according to one embodiment of the present invention.
Figure 5:
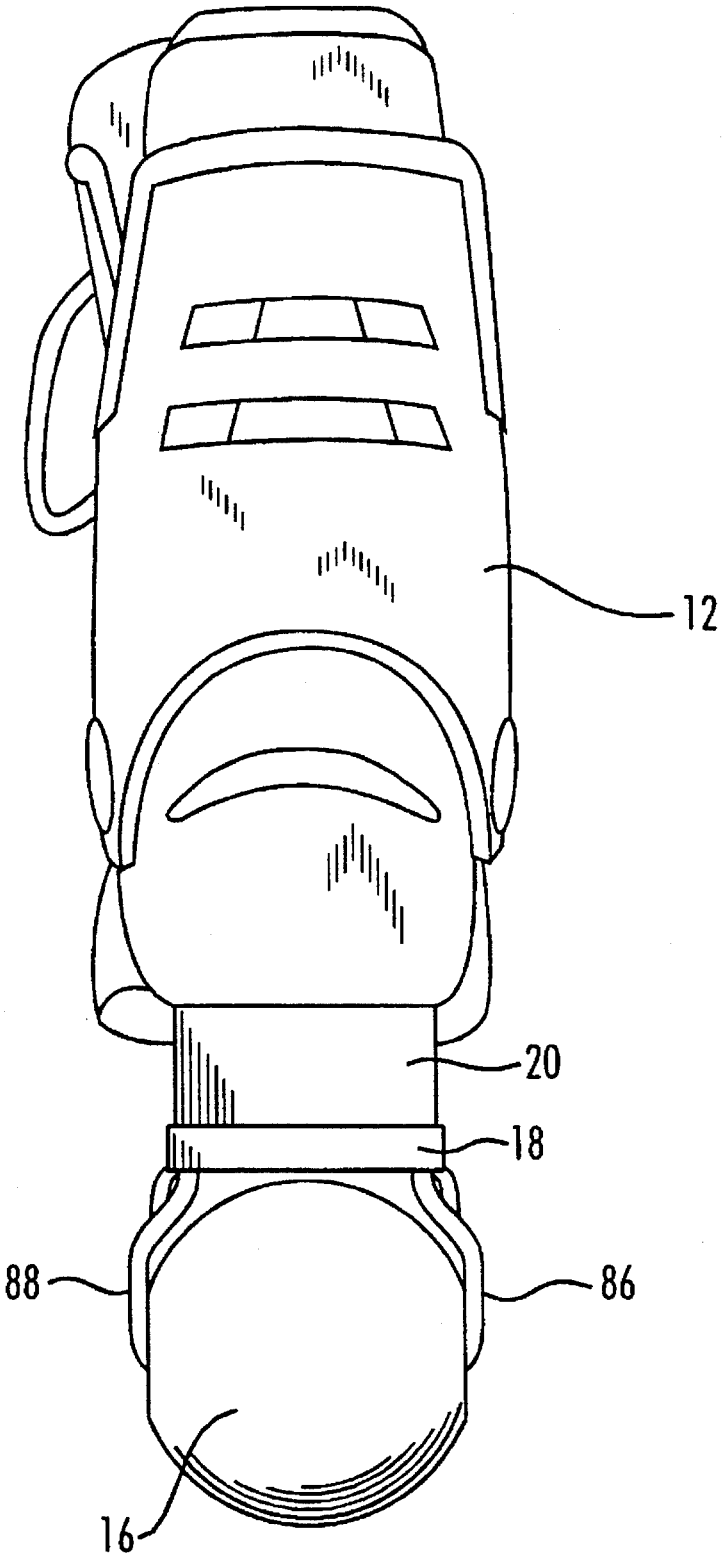
FIG. 5 is a rear view of the roller skate embodiment of FIG. 1.
Figure 6:
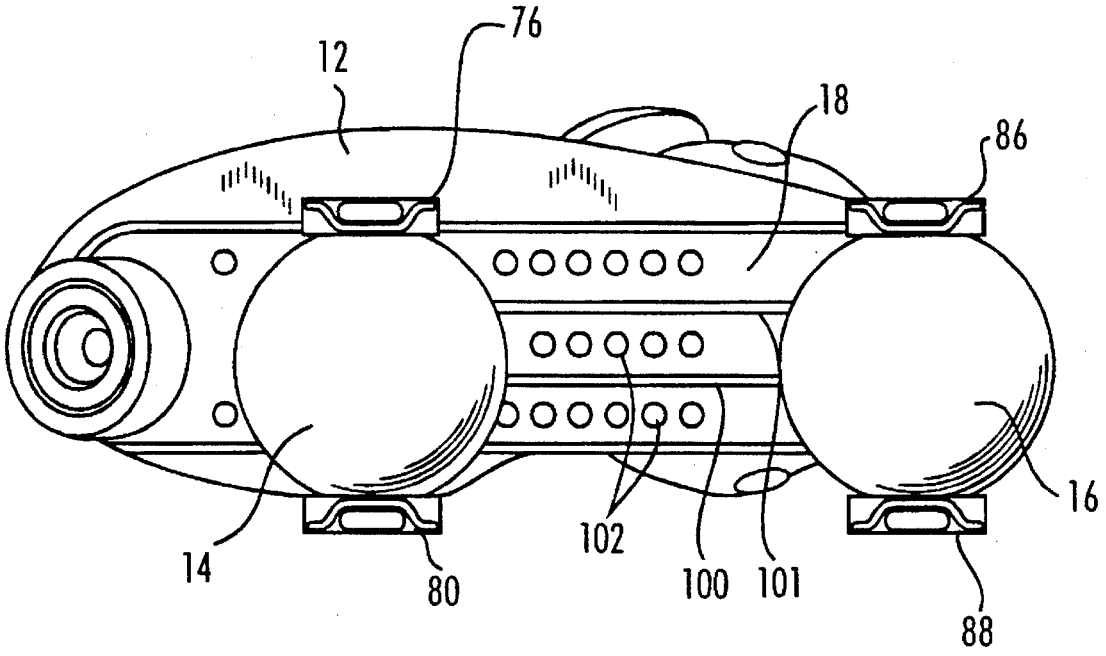
FIG. 6 is a bottom view of the roller skate embodiment of FIG. 1.

An improved roller skate 10, according to an embodiment of the present invention, is shown in FIGS. 1, 5 and 6. While FIGS. 1, 5 and 6 show only one roller skate 10, it will be understood that the skate 10 is intended to be used with a second similarly constructed roller skate (not shown), such that one skate may be worn on the user's right foot and the other skate may be worn on the user's left foot. However, only one skate is discussed in detail herein, since both the right foot skate and the left foot skate have similar construction (except that the shoe portion of the right skate is preferably configured for a right foot and the shoe portion of the left skate is preferably configured for a left foot).

The roller skate 10 includes a shoe portion 12, a front wheel 14, a rear wheel 16, a bracket 18 coupling the wheels 14 and 16 to the shoe portion 12, a heel member 20 provided between the shoe portion 12 and the bracket 18, and a brake 22 coupled to the bracket 18 in front of the front wheel 14. Each of these elements are discussed in further detail below.

The Shoe Portion

The FIG. 1 embodiment of the invention includes a shoe portion 12 for receiving a user's foot. Various shoe portion designs for roller skates are well known in the art and are, therefore, not discussed in detail herein. However, in a preferred embodiment of the present invention, the shoe portion 12 is formed as a relatively light-weight, yet high-strength structure. The shoe portion 12 has a semi-rigid, plastic outer shell 13, in which a soft lining 13*a* is housed. The front of the shoe portion may be fastened about A skater's foot with laces (as shown in the illustrated embodiment) or other suitable fastening devices, such as clips or snaps.

The Wheels

Figure 2:
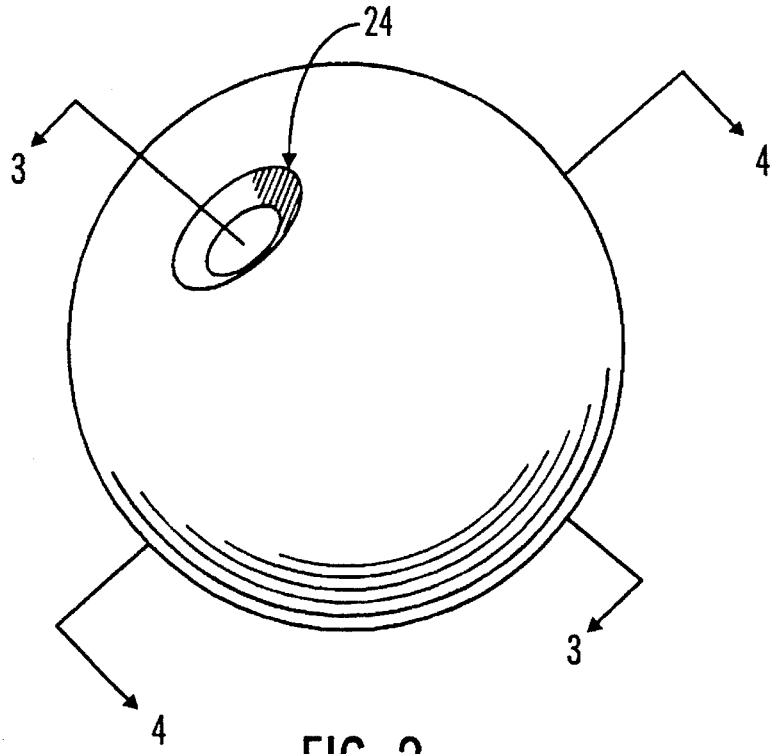
FIG. 2 is a perspective view of a wheel of the roller skate embodiment of FIG. 1.
Figure 4:
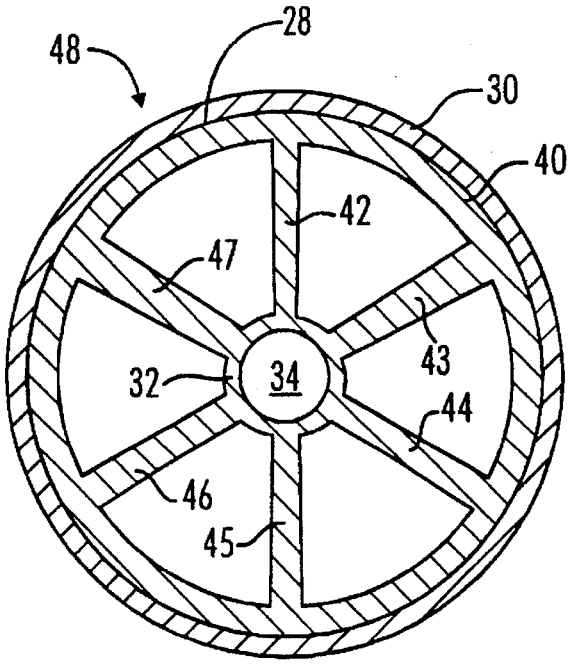
FIG. 4 is a cross-section view of the wheel in FIG. 2, taken along the cross-section indicated at "4—4" in FIG. 2.
Figure 3:
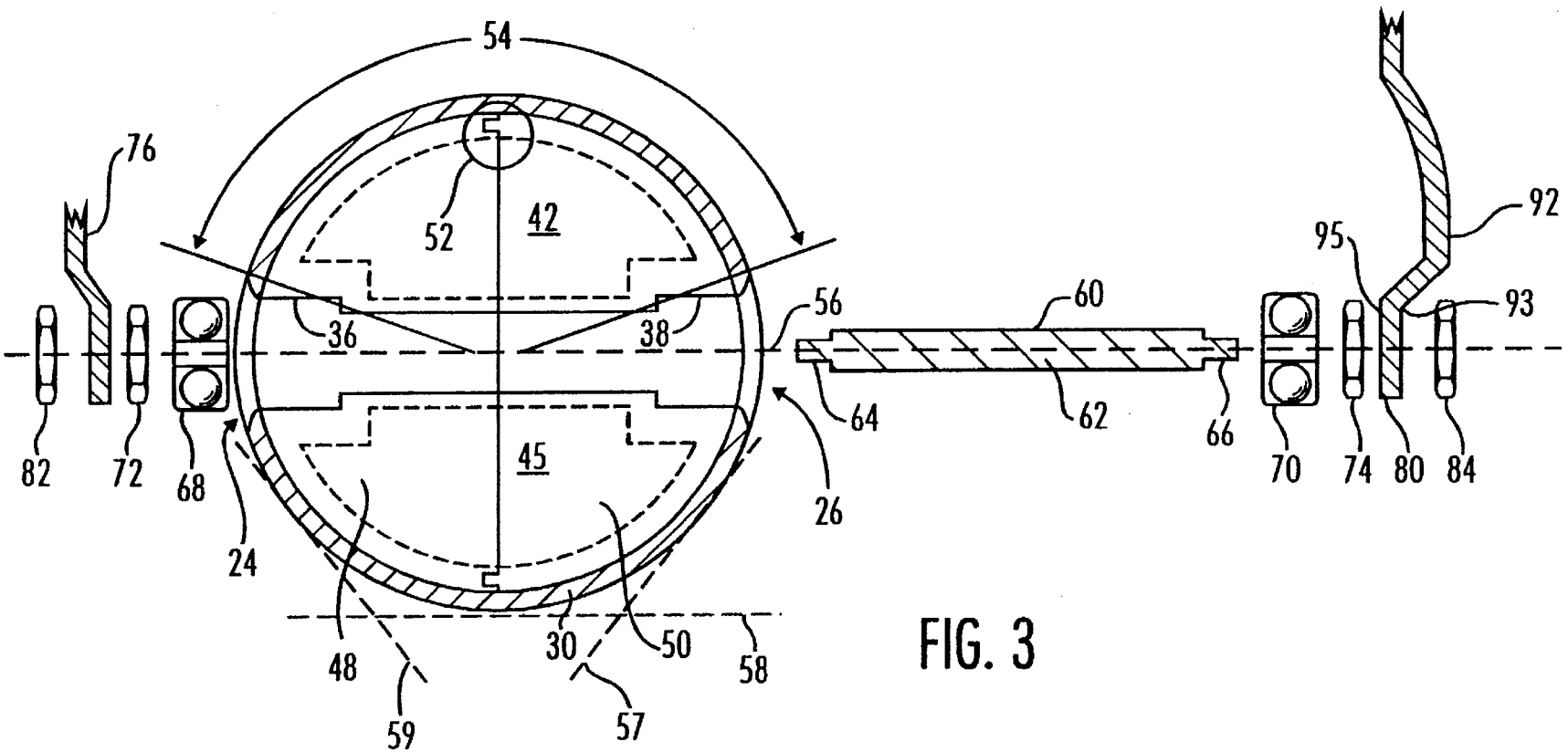
FIG. 3 is a cross-section view of the wheel in FIG. 2, taken along the cross-section indicated at "3—3" in FIG. 2.

The present inventors have recognized that light-weight wheels are preferred for maximizing the performance characteristics of the roller skate. However, in an effort to design a light-weight wheel, the structural strength of the wheel should not be significantly compromised. FIGS. 2–4 illustrate a wheel structure, according to an embodiment of the present invention, which is both light-weight and high-strength.

FIG. 2 is a perspective view of a wheel 14, showing the exterior shape of the wheel. FIGS. 3 and 4 are cross-section views of the wheel 14, showing the interior structure of the wheel. The wheel 16 has a similar structure and shape and, therefore, the discussion of the structure and shape of wheel 14 applies to wheel 16 as well.

The wheel 14 has a "generally" spherical outer peripheral shape, as best shown in FIG. 2. If not for a pair of small indentations 24 and 26 (FIG. 3) located where the axle chamber meets the outer peripheral surface, the wheel 14 would be totally spherical.

As discussed in further detail below, the generally spherical shape of the wheels 14 and 16 in combination with the configuration of the bracket 18 allow the user to maintain a rolling surface of each wheel on the floor or ground, while leaning the skate by a relatively large degree with respect to a line extending perpendicular to the floor or ground. In addition, the structure of each wheel 14 and 16 is designed to provide high-performance operation and ease of manufacture.

Referring to FIGS. 3 and 4, the wheel 14 has a rigid inner core, generally indicated at 28, and a softer outer cover 30. The rigid inner core remains close to the gripping surface of the wheel (separated therefrom by the thickness of the softer outer cover 30) so as to minimize any instability, wobble or distortion of the wheel. In this manner, the positional relationshp of the wheels center of gravity and the gripping surface of the wheel does not significantly shift during use.

The inner core 28 includes a substantially cylindrical axle housing 32 which defines a hollow interior 34 for receiving an axle. Each end of the axle housing 32 opens into a larger diameter, substantially cylindrical bearing housing 36 and 38, for receiving a wheel bearing member. For a wheel of 70 mm in diameter, the distance between bearing housings 36 and 38 is preferably substantially 43 mm, where an axle of substantially 43.5 mm in length (instead of 43 mm, to prevent the bearings from blocking when operating within the bearing housings) is housed in the axle housing 32.

The inner core 28 further includes a hollow, "generally" spherical, rigid shell 40. But for two small cylindrical indentations, defining the wheel bearing housings 36 and 38, the shell 40 is totally spherical. A plurality of spokes 42–47 extend along the length of the axle housing 32 and radially outward therefrom to the interior surface of the shell 40. The spoked structure provides a light-weight inner core (e.g., with respect to a solid structure), yet provides sufficient strength for enduring the rigorous strains typically experienced by a roller skate wheel.

The outer dimension of the core 28 is important in determining the outer dimension of the wheel formed therewith. After a number of tests of different wheel sizes, it was found that a wheel size of substantially 70 mm diameter provided the ability for a skater to attain a large, and possibly maximum, angle of inclination, while maintaining the riding surface of the wheel in a controllable rolling contact with the ground or floor.

In order to produce wheels of accurate dimensions, the cores 28 should be formed in accurate dimensions. In a preferred embodiment, the wheel core 28 is formed in a molding process or in a pressing process. Accordingly, the material chosen to form the core 28 is preferably of the type which is suitable for molding or pressing, yet will not significantly deform or change in dimension during the cooling step of the molding or pressing process, and which provides sufficient strength characteristics to withstand prolonged and rigorous skating.

The ability of the core material to maintain its shape and dimension (and to avoid deformation) during the cooling steps is further advantageous for embodiments, as discussed below, wherein two "generally" semispherical portions are coupled together to form the "generally" spherical core. In such an embodiment, the mating surfaces of the two "generally" semispherical portions should be accurately dimensioned and free of deformations so as to avoid gaps between the mating surfaces. Such gaps could allow the material used to form the soft outer cover 30 to seep into the interior of the core.

In certain wheel embodiments discussed below, the soft outer covering 30 is formed by injection molding the covering material over the core and cooling the covering material. In such embodiments, the material used to form the core 28 is preferably of the type which will not significantly deform or cause a change in dimension during the injection molding and cooling steps of forming the covering 30.

In order to address the above concerns regarding the material used to form the core 28, a plastic matrix with a glass load of at least 25% and preferably 30% was chosen (preferably NYLON GLASS 30% made by BAYER ITALIA (a trademark)).

As noted above, in a preferred embodiment, the inner core 28 is formed of two molded or pressed, "generally" semispherical portions 48 and 50. FIG. 4 shows one of these "generally" semispherical portions 48. The other portion 50 is substantially similar to portion 48. Each portion 48 and 50 includes a half of shell 40, a half of axle housing 32 and a half of each spoke 42–47. The "generally" semispherical portions 48 and 50 are coupled together to form a "generally" spherical shaped structure, as shown in FIG. 2.

The "generally" semispherical portions 48 and 50 may be welded together. However, in preferred embodiments, the portions 48 and 50 are coupled together by mechanical coupling means, generally indicated at 52, disposed about the periphery of the mating edges of the shell 40 halves. The mechanical coupling means 52 ensures that the wheel dimensions to which the portions 48 and 50 are molded are not altered by the coupling process and provides an accurate alignment of the axle housing 32 halves and the shell 40 halves. In addition, the mechanical coupling means 52 prevents the material used to form the outer cover 30 from seeping into the interior of the core during the step of forming the cover 30 by injection molding. Seepage of the cover material into the interior of the core will result in an increase in the weight of the wheel and/or the weight of the wheel being off-center.

Various means for mechanically coupling the "generally" semispherical portions together may be employed. However, a preferred mechanical coupling means 52 is shown in FIG. 3 and is composed of a mating groove and tongue arrangement formed about the abutting edges of the shell 40 halves. One shell half (shown on the left side of FIG. 3) has a generally "U" shaped groove 49 and the other shell half (shown on the right side of FIG. 3) has an outward extending tongue 51 configured to fit into the groove 49. In a preferred embodiment, the dimensions of the groove 49 and the tongue 51 are such that the tongue snap-fits into the groove to rigidly couple the two "generally" semispherical portions 48 and 50 together to form core 28. The "U"-shaped connection fit inhibits the covering material from penetrating the interior of the mechanically coupled core.

In a preferred embodiment, two parallel grooves, each about 0.05 mm deep, are formed on the outer periphery of each "generally" semispherical portion 48 and 50 to support the two sealing side walls of the portions 48 and 50, to inhibit the plastic covering from breaking off of the core during high stress operating conditions, e.g., when the skater skids to one side.

The outer cover 30 covers the entire inner core 28 except for the portions of the inner core which define the interior of the bearing housings 32 and 34. In the illustrated embodiment, the outer cover 30 defines tapered circular (or conical) indentations 24 and 26 opening into the bearing housings 32 and 34. The bearing housings and the indentations 24 and 26 allow the wheel axle, wheel bearings and axle ends to be encompassed completely within the sphere defined by the outer peripheral surface of the cover 30. As a result, the axle and bearing components will not protrude from the wheel and, thus, will not scrape the ground or floor when the skate is leaned or angled with respect to the ground or floor.

Preferably, the outer cover 30 is an approximately 5 mm thick layer of a material which is softer than the rigid material used to form the inner core 28. That is, the material for the outer cover 30 is preferably chosen to be soft enough to provide sufficient traction to inhibit sliding of the wheels along the ground or floor (e.g., as the skater makes fast, sharp turns or trick maneuvers), yet not so soft as to increase the frictional drag between the wheel and the ground or floor to a degree at which the skater's performance is adversely affected.

In addition, it is preferred that the material for the outer cover 30 be suitable for injection molding about the core 28. Thus, the material should not be too flexible and "rubbery". Furthermore, the material must be suitable for binding to the outer peripheral surface of the core 28. If injection molded to the outer peripheral surface of the core 28, the cover 30 material must have a melting point low enough to avoid imparting excessive heat to the core 28 during the injection molding process. Excessive heat and subsequent cooling to form the cover 30 may cause the core 28 to deform. Therefore, it is preferred that the material chosen for the cover 30 have a melting point not in excess of 160 degrees Celsius, where the core material, when cold, can withstand temperatures up to 210 degrees Celsius without significant deformation.

In order to address the above concerns regarding the material used to form the outer cover 30, a plastic material (APILON 52 (85 s.), manufactured by the Italian subsidiary of the German company API) was chosen.

In a preferred embodiment, a wheel 14 or 16 is made by molding or press forming the two "generally" semispherical portions 48 and 50 out of a plastic matrix with a glass load of 30% (preferably NYLON GLASS 30% made by BAYER ITALIA). The wall of the shell 40 is formed approximately 2 mm thick. The walls around the wheel bearing housing portions 36 and 38 are formed approximately 3 mm thick, for added strength in the area at which the core 28 is coupled to the axle.

The two "generally" semispherical portions 48 and 50 are then coupled together, via the mechanical coupling means 52 to form a 60 mm diameter, "generally" spherical core 28. A cover 30 is formed about the core 28 by injection molding, to provide a 5 mm thick layer of a softer plastic material (preferably, APILON 52 (85 s.). The pressure for injecting the plastic material into the mold should not exceed 10 ATM so as to avoid collapsing the core. The cover 30 is then cooled to form a 70 mm diameter wheel structure as shown in FIG. 2.

The wheel is then weighed to determine whether the cover material seeped into the interior of the core during the steps of forming the cover. If the wheel weighs more than a predetermined weight (predetermined to be the weight of a wheel with no seepage of the cover material into the core), then the wheel is determined to be defective. A wheel which passes the weight test is then assembled with the axle and bracket arms, as shown in FIG. 3.

As shown in FIG. 2, the wheel structure, being "generally" spherical, defines a relatively large outer peripheral surface suitable to make rolling contact with the ground or floor. That is, the "generally" spherical shape of the outer surface of the wheel defines a relatively large arc (best shown at 54 in FIG. 3) which defines the riding surface area of the wheel—the area of the surface which can make controllable rolling contact with the ground or floor. This relatively large rolling surface area allows the axis of rotation 56 of the wheel to be at a relatively large angle with respect to the plane of the ground or floor and still be operable to roll in a controllable manner along the ground or floor. Examples of some of the various angles with which the rotation axis 56 can make with the plane of the ground or floor are shown in FIG. 3, wherein the plane of the ground or floor is shown in broken lines at 57–59.

This feature allows the skater to lean the skate to a relatively great extent with respect to a line extending perpendicular from the plane of the ground or floor. As a result, the skater has a greater ability to lean into high speed and/or sharp turns and has a greater ability to ride along angled surfaces than the skater would have with conventional disk-shaped wheels discussed above. It is believed that a skilled skater could have the physical ability to lean a skate as far as about 70 degrees from a line perpendicular to the plane defined by the ground or floor, provided that the structure of the skate will allow such a lean. Therefore, in a preferred embodiment, the arc 54 is about 140 degrees so as to define a riding surface area of the wheel sufficient to accommodate a lean of up to about 70 degrees.

The relatively large arc 54 feature, in combination with the high-strength and light-weight wheel core structure and soft outer cover discussed above, provides a significantly improved high-performance wheel which allows the skater to maintain a controllable forward or backward movement of the skate, even with the skate at a substantial angle or lean. The resulting sensation felt by the skater is similar to that of an ice skate (which, by virtue of a thin blade adapted to "cut" into the ice, can be leaned or angled relative to the ice surface and still maintain a controllable forward movement).

As shown in FIG. 3, the hollow interior 34 of the axle housing 32 is adapted to receive therein an axle 60. The axle 60 has a smooth central cylindrical portion 62 and two threaded ends 64 and 66, respectively. When received within the axle housing 32, the ends 64 and 66 of the axle 60 extend into the bearing housing portions 36 and 38, respectively.

A first wheel bearing member 68 fits into the bearing housing portion 36, over the axle end 64 and abuts the smooth central portion 62 of the axle, adjacent the threaded end 64. A second wheel bearing member 70 fits into the bearing housing portion 38, over the axle end 66 and abuts the smooth central portion 62 of the axle, adjacent the threaded end 66. The axle 60 is non-rotatable. However, by virtue of the bearing members 68 and 70 (e.g., ball bearings encased within races) supporting the core 28 on the axle 60, the wheel is rotatable about the axis of the axle 60 (the axis of rotation 56 of the wheel).

A pair of nuts 72 and 74 are threaded over the axle ends 64 and 66, respectively, to retain the bearing members 68 and 70 in place within the bearing housing portions 36 and 38, respectively. Arms 76 and 80 of the bracket 18 are provided with apertures for receiving the axle ends 64 and 66 which extend through the nuts 72 and 74. A second pair of nuts 82 and 84 are threaded over the axle ends 64 and 66, respectively, on the opposite side of the arms 76 and 80 with respect to the side of the arms adjacent nuts 72 and 74. In a preferred embodiment, the nuts 72 and 74 are omitted and the wheel-facing surface (surface 95 on arm 80 in FIG. 3) of each arm 76 and 80 abuts and retains the bearing member 68 or 70.

Preferably, the length of the axle 60 and the shape of the arms 76 and 80 are such that the axle 60, the bearing members 68 and 70, and the nuts 72, 74, 82 and 84, when assembled with the wheel structure, are positioned within the sphere defined by the outer peripheral surface of the cover 30. As a result, these elements will not protrude from the wheel and, thus, will not be in a position to scrape the ground or floor when the skate is leaned or angled with respect to the ground or floor.

The Bracket

As shown in Fig. a bracket 18 couples the wheels 14 and 16 to the shoe portion 12. The shape of the bracket is preferably designed for strength as well as to allow for a high degree of skate inclination (lean or angle) with respect to the ground or floor without contacting and scraping the ground or floor. Preferably, the width of the bracket 18 is no greater than (and preferably less than) the maximum width of the shoe portion 12. This allows the bracket to be relatively thin, so as not to contact the ground or floor at high degrees of skate inclination. This also allows the bracket to be formed as a relatively light-weight structure.

The bracket 18 includes a first pair of arms 76 and 80 coupled to the front wheel 14, in the manner discussed above. The bracket 18 also includes a second pair of arms 86 and 88 coupled to the back wheel 16 in a similar manner.

Each arm includes a wheel connecting portion (90 on arm 80 in FIG. 1) which is configured to extend into an indentation (26 in FIG. 3) of the wheel, when coupled to the axle (60 in FIG. 3) as discussed above. This feature allows the axle, wheel bearing members and connecting hardware to be located within the sphere defined by the outer peripheral surface of the cover 30.

Each arm includes a curved portion (92 on arm 80 in FIG. 3) which curves the arm around and follows the outer contour of the wheel, as shown in FIGS. 1 and 5. A bend (93 on arm 80) forms a flat wheel connecting portion (90 on arm 80 in FIG. 1) defining a planar, wheel-bearing-facing surface (95 on arm 80 in FIG. 3) of the arm. The wheel-bearing-facing surface (95 on arm 80) rests against the wheel bearing member (70 in FIG. 3), within the sphere defined by the outer peripheral surface of the cover 30.

The curvature of the arms is designed to allow for a high degree of skate inclination (lean or angle) with respect to the ground or floor, with the arms and the hardware connecting the arms to the wheels positioned so as to avoid contacting and scraping the ground or floor when the skate is inclined. The curvature of the arms also allows the base portion 96 of the bracket to be made relatively thin. That is, the arms curve out and around a portion of the wheels such that the width of the base portion 96 can be smaller than the diameter of the wheels.

In a preferred embodiment, the location of the arms with respect to the shoe portion 12 is designed to accommodate favorable performance characteristics, in terms of heel stability and toe maneuverability. In a preferred embodiment, the arms 76 and 80 are located such that the axle aperture in each arm is about 8.5 cm from the toe end of the shoe portion, and the arms 86 and 88 are located such that the axle aperture in each arm is about 3.5 cm from the heel end of the shoe portion 12.

The base portion 96 is coupled to the shoe portion 12 by any suitable means, such as bolts, screws, rivets, welds or the like. Arms 76, 80, 86 and 88 are fixed to the base and extend from the base to the wheels 14 and 16. The base 96 is composed of two base halves 98 and 99, respectively. The base halves 98 and 99 are arranged adjacent to each other and are adapted to slide with respect to each other in order to adjust the overall length of the base 96 to accommodate various shoe portion lengths.

Strength and safety are a great concern in designing high-performance skates. Such skates are often subjected to extreme stresses and strains, for example, during high speed turns, jumps or trick maneuvers. In the illustrated embodiment, each base half 98 and 99 has one or more length-wise ribs (two ribs 100 and 101 are shown in FIG. 6) for enhancing the strength of the bracket. Moreover, in a preferred embodiment, the base portion 96 and the arms 76, 80, 86 and 88 are made of 3 mm thick, deep pressed sheet metal (e.g., steel).

Each base half 98 and 99 is provided with a plurality of rows of apertures 102 along its length. The base halves 98 and 99 may be arranged adjacent each other in a position at which at least one hole 102 in one base half aligns with at least one hole in the other base half. By passing a bolt, screw, rivet or the like through the aligned holes, the base halves are coupled together and define a particular bracket length.

The Heel Member

It has been found that a slight rise in the skater's heel can be advantageous to the skater's performance. A slight rise in the heel will tend to cause the skater's shins to lean slightly forward and the skater's knees to bend. As shown in FIG. 1, a heel member 20 is provided between the bracket 18 and the shoe portion 12, adjacent the heel of the shoe portion, to raise the heel of the shoe portion above the bracket 18.

The heel member 20 is a rigid structure formed of any suitable material. In a preferred embodiment, the heel member is made of a relatively light-weight, rigid plastic material, such as polyester foam.

The Brake

As shown in FIG. 1, a brake 22 is mounted to the front of the bracket 18, in front of the front wheel 14. The brake 22 includes a pad 104 made of a hard rubber-like material supported on an iron core 106. Spacers (not shown) made of polyester foam are arranged between the pad 104 and the core 106 to provide a tight fit of the pad over the core.

All or various combinations of the above features may be included in a high-performance roller skate according to embodiments of the present invention. As discussed above, embodiments of the high-performance roller skate are capable of higher speeds, greater inclinations of the skate relative to the ground or floor, greater maneuverability and greater control than various conventional roller skates.

While the description above generally relates to an improved roller skate, it will be understood that, according to further embodiments of the invention, various features of the above discussed roller skate can be employed on other types of skate devices, such as skate-boards, or the like.

The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. An improved skate device comprising:

(a) a plurality of wheels, each wheel having
  (i) an axis of rotation,
  (ii) a generally spherical outer peripheral shape with an indentation at each location at which the axis of rotation traverses the generally spherical outer periphery of the wheel, and
  (iii) a core adjacent the generally spherical outer periphery of the wheel, the core having
    (A) a generally hollow outer shell defining an inner peripheral surface and an outer peripheral surface,
    (B) an axis of rotation in common with the axis of rotation of the wheel,
    (C) a generally spherical shaped peripheral surface with a generally cylindrical indentation at each location at which the axis of rotation of the wheel traverses the peripheral surface of the shell,
    (D) an axle housing extending along the axis of rotation of the wheel, and
    (E) a plurality of spokes extending from the axle housing to the inner peripheral surface of the outer shell and extending along substantially the entire length of the axle housing; and (b) a bracket coupled to the wheels, the bracket having a base and at least one arm associated with each wheel, the at least one arm being connected to its associated wheel inside one of said indentations.

2. An improved skate device as recited in claim 1, wherein the bracket has a pair of arms associated with each wheel and each pair of arms is connected to its associated wheel inside the indentations in the outer periphery of the wheel.

3. An improved skate device as recited in claim 1, further comprising a shoe portion, wherein said bracket couples said wheels to said shoe portion.

4. An improved skate device as recited in claim 2, wherein arm of the pair of arms is separately affixed to the base.

5. An improved skate device as recited in claim 1, wherein the axle housing comprises a generally hollow, cylindrical member provided inside of the generally hollow outer shell.

6. An improved skate device as recited in claim 1, wherein each wheel further comprises a cover disposed over the outer peripheral surface of the shell, the cover being made of a softer material that the material from which the shell is made.

7. An improved skate device as recited in claim 1, wherein the core comprises two core halves and means for coupling the core halves together.

8. An improved skate device as recited in claim 7, wherein each core half includes substantially half of the axle housing and substantially half of each spoke.

9. An improved skate device as recited in claim 7, wherein said means for coupling the core halves together comprises a mechanical coupling system.

10. An improved skate device as recited in claim 7, wherein each half core defines a coupling surface for abutting the other half core upon coupling the core halves together, and wherein said means for coupling the core halves together comprises a groove formed on the coupling surface of one of said half cores and a tongue formed on the coupling surface of the other half core, said tongue being dimensioned to fit within said groove upon coupling the core halves together.

11. An improved skate device as recited in claim 1, wherein the generally spherical outer peripheral shape of each wheel defines a rolling surface area extending in the direction around the axis of rotation of the wheel and extending across an arc defined from one indentation to the other indentation, wherein said arc is approximately 140 degrees.

12. An improved roller skate, comprising a shoe portion;

a pair of wheels, each wheel having an axis of rotation and a generally spherical shaped outer peripheral surface which is traversed in two locations by the axis of rotation, the generally spherical shaped outer peripheral surface having an indentation at each location at which the axis of rotation traverses the wheel periphery;

a bracket coupling the wheels to the shoe portion, the bracket having a pair of arms associated with each wheel, each pair of arms being connected to their associated wheel inside one of said indentations;

each wheel having an inner core and a cover disposed over the inner core, the cover being made of a softer material that the material from which the shell is made;

the inner core of each wheel having a generally hollow outer shell defining an inner peripheral surface and an outer peripheral surface, an axle housing extending along the axis of rotation of the wheel, and a plurality of spokes extending from the axle housing to the inner peripheral surface of the outer shell;

the inner core of each wheel being composed of two core halves and coupling means for coupling the core halves together;

wherein each core half defines a coupling surface for abutting the other core half upon coupling the core halves together, and wherein said means for coupling the core halves together comprises a groove formed on the coupling surface of one of said core halves and a tongue formed on the coupling surface of the other core half, said tongue being dimensioned to fit within said groove upon coupling the core halves together; and wherein the generally spherical outer peripheral shape of each wheel defines a rolling surface area extending in the direction around the axis of rotation of the wheel and extending across an arc defined from one indentation to the other indentation, wherein said arc is approximately 140 degrees.

* * * * *